United States Patent [19]

Martz

[11] 4,064,699

[45] Dec. 27, 1977

[54] BOILER CONTROL PROVIDING IMPROVED OPERATION WITH FUELS HAVING VARIABLE HEATING VALUES

[75] Inventor: Lyle F. Martz, Penn Hills, Pa.

[73] Assignee: Westinghouse Electric Corporation, Pittsburgh, Pa.

[21] Appl. No.: 720,328

[22] Filed: Sept. 3, 1976

[51] Int. Cl.[2] ..... F01K 13/00

[52] U.S. Cl. ..... 60/664; 60/667; 122/448 R

[58] Field of Search ..... 60/664, 665, 667; 236/11, 14; 122/448 R; 290/40 R

[56] References Cited

U.S. PATENT DOCUMENTS

| | | | |
|---|---|---|---|
| 3,417,737 | 12/1968 | Shinskey et al. | 122/448 R |
| 3,545,207 | 12/1970 | Barber et al. | 122/448 R |
| 3,607,117 | 9/1971 | Shaw et al. | 122/448 R |

*Primary Examiner*—Allen M. Ostrager
*Attorney, Agent, or Firm*—E. F. Possessky

[57] ABSTRACT

A boiler control regulates the input fuel and air to satisfy load demand. Simultaneously, the air flow is adjusted by an air flow control to correct for changes in fuel heating value by means of a circuit which operates in response to outlet steam flow and input mass fuel flow to determine the difference in presumed heat input and actual heat output and, by inference from the heat imbalance or error, a change in fuel heating value. The heat error is used to adjust the air flow demand to the air flow control. In another embodiment, boiler heat pickup is derived to remove from the heat imbalance any heat input changes other than fuel heating value changes.

15 Claims, 5 Drawing Figures

BOILER CONTROL PROVIDING IMPROVED OPERATION WITH FUELS HAVING VARIABLE HEATING VALUES

CROSS-REFERENCE TO RELATED APPLICATIONS

Coassigned Serial No. 720,329 (W.E. 46,191) entitled "Boiler Control Having A Heating Value Computer And Providing Improved Operation With Fuels Having Variable Heating Values", filed by L. Stern concurrently herewith and referenced herein because it objectives are similar to those of the present disclosure.

BACKGROUND OF THE INVENTION

The present invention relates to control systems for steam generators and the like and more particularly to control systems for boilers employed in electric power plants.

Various kinds of fuels can be used in the operation of power plant and other boilers, and some of these fuels such as coal, waste gases or other solid fuels can vary significantly in heating value. Other fuels such as natural gas and oil exhibit little variance in heating value.

The operation of a boiler is affected by fuel heating value changes since at a fixed fuel flow an increase or decrease in fuel heating value results in increased or decreased boiler heat input rate and ultimately increased or decreased heat output rate. For example, if the pulverized coal feed rate is set at a particular value and the BTU content of the coal drops, the boiler outlet steam will ultimately drop in pressure and temperature. In most boiler controls, a change in outlet steam conditions results in corrective fuel inflow which causes the steam conditions ultimately to return to desired values. The present invention is related to an improved arrangement in which corrections are made in boiler operations as a result of fuel heating value changes.

In electric power plants, it has long been common to control fuel input to hold outlet steam pressure from boilers at a regulated value and independently to compare inlet air flow to outlet steam flow and operate the fans to make corrective inlet air flow changes. During load changes, this "steam flow/air flow" system results in overfiring on load increases and underfiring on load drops. After a disturbance occurs in outlet steam conditions because of a fuel heating value change, the control ultimately operates the boiler to correct the steam conditions in the steady state. However, improper fuel/air balance can result in inefficiency. For example, the plant may be increased to maximum allowed air flow so that further load increase is not permitted yet maximum load would not have been reached because fuel has not been increased in balance with the inlet air increase.

Provisions have been made in the prior art for adjusting boiler operations when changes occur in fuel heating value, but so far as is known such provisions have been limited to steam flow/air flow type systems in which process transient response to control actions has been generally poor. U.S. Pat. No. 2,328,498 exemplifies this approach.

In the more recent parallel type of boiler control system encouraged by the increased use of once-through boilers, input fuel and air both controlled in response to outlet steam flow to provide good steady state response and fast and smooth transient response to load changes. Further, oxygen detection has been used in the parallel type of control to adjust air flow as changes occur in the rate at which burnable fuel enters the combustion zone, and as a result some correction does occur in air flow control for changes in fuel heating value. However, to prevent smoking or more generally to hold the fuel and air in proper balance, the corrections are made only in the fuel/air balance based on a signal corresponding to the existing input flow rate which is incorrect to hold desired outlet steam conditions at the existing load because its heating value has changed. This approach is not entirely adequate because it involves excessive process transient behavior in the course of achieving process corrections for fuel heating value changes. Thus, a steam pressure upset is always followed by a fuel/air balance upset and load changes are always accompanied by fuel transients if the fuel heating value has changed from the value to which the control system is tuned.

One other prior art approach involving an adjustment effect for fuel heating value variation in the parallel type boiler control is one in which steam flow and drum pressure rate of change are used to develop a heat release signal. A high select is then made on the heat release signal and a signal indicative of the mass input fuel flow. As a result, the system functions only on high select and accordingly is useful principally to prevent boiler smoking on load pickups or on the sudden inflow of a richer fuel. If a poorer fuel begins to be used, the system has no direct response because of the high select arrangement. Further, with the use of drum pressure rate of change, the system is responsive only to load transients or more or less step changes in the heating value of input fuel. Fuel heating value changes most often occur over long time periods such as several days, and the system using drum pressure change rate is accordingly not responsive to provide direct corrective action for changes in fuel heating value under most circumstances.

It has also been the practice in some cases to obtain a fuel sample and determine its heating value with the use of an off-line calorimeter. The plant operator subsequently makes a control system adjustment in accordance with the sampling results, and the plant is then tuned and can be properly operated. However, this approach does not provide continuous adjustment.

To provide continuous control adjustment for changes in fuel heating value, it might be desirable to employ a device which can directly and continuously sense fuel heating value and generate a signal representative of it. However, no such device is known to be available for commerical applications. Therefore, in providing boiler operating corrections in response to full heating value changes, the present invention employs signals representative of conditions which are inferentially related to fuel heating value. The present application is directed to certain basic and specific aspects of the invention while the cross-referenced application is directed to an improvement embodiment.

SUMMARY OF THE INVENTION

A control system for a boiler or other fluid heaters in which inlet fluid is heated to an elevated temperature and pressure comprises means for generating a representation of load on the boiler and means for generating a demand for input fuel and a demand for input air as a function of the boiler load. There are additionally provided means for generating respective representations of boiler outlet fluid flow and input fuel flow, means for controlling the input flow of fuel to satisfy the fuel demand, means for controlling the input flow of air to satisfy the air demand, and means for correcting one of said controlling means for changes in fuel heating value as a function of the outlet fluid flow and input fuel flow representations.

DESCRIPTION OF THE PREFERRED EMBODIMENT

Figure 1:
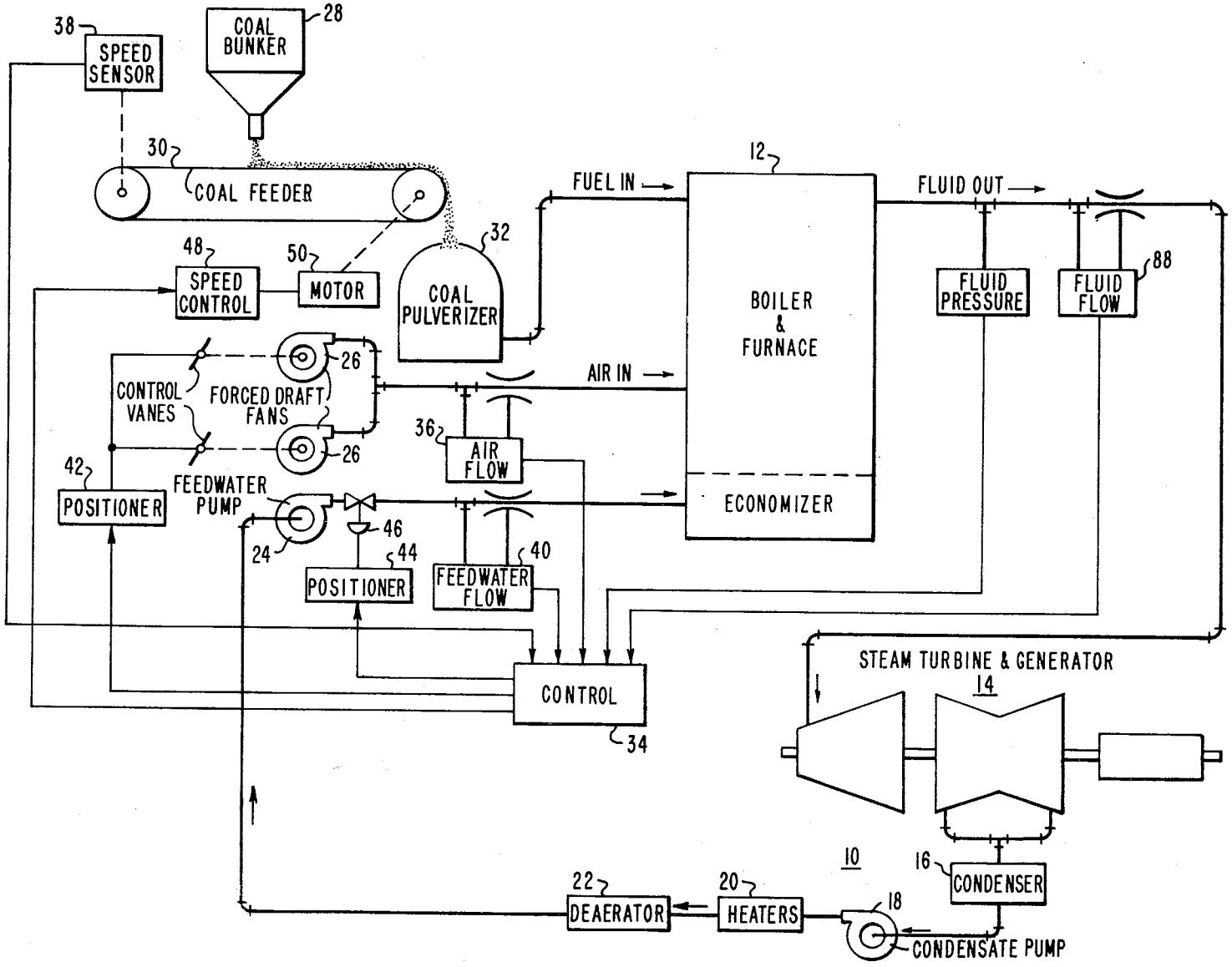
FIG. 1 shows a block diagram of an electric power plant having a boiler control operating in accordance with the principles of the invention.

More specifically, there is shown in FIG. 1 an electric power plant 10 having a fossil fired drum type boiler 12 which supplies hot fluid or steam at elevated pressure and temperature to a turbine generator 14. Condensate flow from a condenser 16 is returned by a pump 18 through heater 20 to a deaerator 22. A boiler feedpump 24 drives the fluid into the boiler 12 where it enters the economizer tubes and picks up heat as its passes through all of the boiler tubing to the boiler outlet.

Fuel is supplied to the boiler in a boiler combustion zone where it is combined with oxygen from air supplied by forced draft fans 26. In this case, the fuel is coal supplied from a bunker 28 to a plurality of conveyor feeders 30. The coal is dropped from the feeders 30 into a pulverizer 32, and the pulverized fuel is transported to the burners in furnace part of the boiler 12. In alternate applications of the invention, other types of heaters such as once-through boilers and hot water heaters can be employed.

A boiler control system 34 responds to predetermined signals to operate the various boiler subsystems and safely regulate the boiler outlet steam conditions to satisfy the plant electrical load demand as changes occur in that demand or in the fuel heating value. Generally, an air flow signal is provided by a transmitter 36, mass fuel flow is represented by a signal generated by a feeder speed sensor 38 or other suitable mass sensing device and a water flow signal is provided by a feedwater flow transmitter 40. In other applications of the invention, suitable fuel volume or other fuel measuring devices can be employed and the output signals thereof are processed in a manner similar to the processing of the mass fuel signal. At the outlet side of the boiler, a pressure transducer 42 generates a signal representative of boiler outlet pressure and a flow transmitter 44 generates an outlet fluid flow signal. Alternately, outlet fluid flow could be represented for example by a signal generated by a turbine impulse chamber pressure sensor (not shown).

Boiler outlet fluid conditions are controlled by varying the inlet water, air and fuel. For this purpose, the control 34 applies an air flow demand to a positioner 42 which operates control vanes associated with the fans 26, a feedwater demand to a positioner 44 which operates a feedwater valve 46, and a fuel demand to a speed control 40 which operates a feeder drive motor 50. The control 34 is internally structured to cooperate with the rest of the plant in generating air, water and fuel demands which provide improved control over boiler outlet fluid conditions as changes occur in plant demand or fuel heating value. Generally, the control 34 includes state of the art circuits to achieve individual circuit functions and the circuits are interrelated in a new way to provide an improved system. Although the invention is preferably embodied with hardware circuits, it can be embodied in a software or hardware/software.

Figure 2:
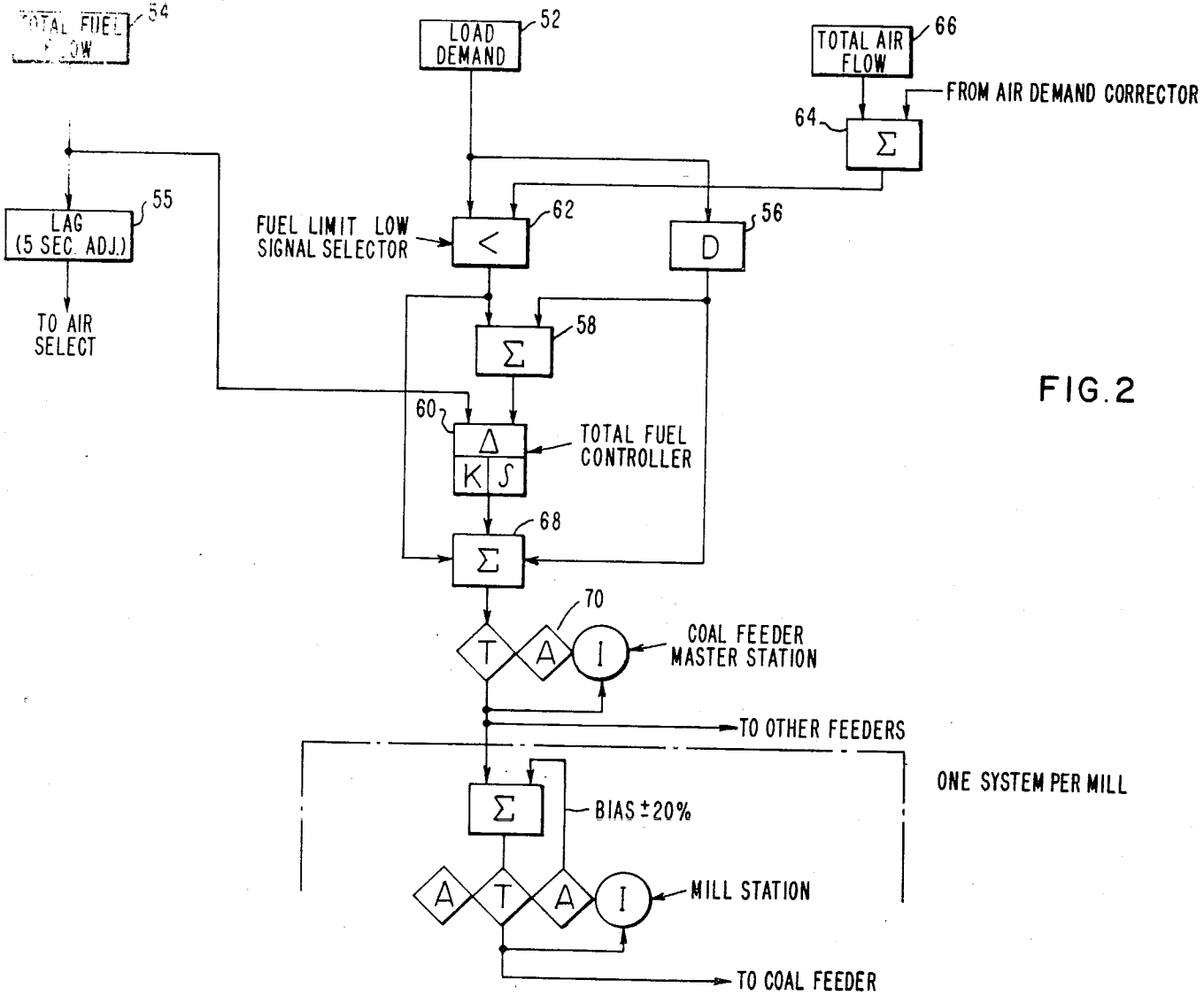
FIG. 2 shows a functional block diagram of a fuel control portion of the control system shown in FIG. 1.

In FIG. 2, the fuel control part of the control 34 is shown in greater detail. A fuel demand signal is provided by block 52 from a plant master load demand signal. An actual fuel flow signal is generated by block 54 on the basis of the total feeder flow as represented by a speed signal from each coal feeder, and it is applied to a lag block 55 for use in cross limiting the demand for air flow and for use as a feedback signal in fuel control.

A rate block 56 develops a rate of change signal from the fuel demand signal to provide faster initial response to fuel demand changes. Thus, the rate signal is summed with the fuel demand signal in summer block 58 and the summer output is applied as a fuel demand to a proportional plus integral fuel controller 60 where it is differenced with the fuel feedback signal.

To prevent fuel demand from exceeding operative air flow capacity, a low select block 62 compares the fuel demand from the block 52 with a permissible fuel demand generated by block 64 and corresponding to the total air flow from block 66. Accordingly, the output fuel demand from the low select block 62 is applied to the summer 58.

The controller 60 generates an output fuel control signal on the basis of the fuel error, and the fuel control signal is applied to another summer 68 which is coupled to a master manual/automatic station 70. The summer 68 adds the fuel control signal and the rate signal from the block 56 and the fuel demand from the low selector 62 to provide the fuel control signal which is transmitted through the master M/A station 70 to the individual manual/automatic stations for the coal feeders where it is used as a speed demand for the feeder motor speed control.

Figure 3:
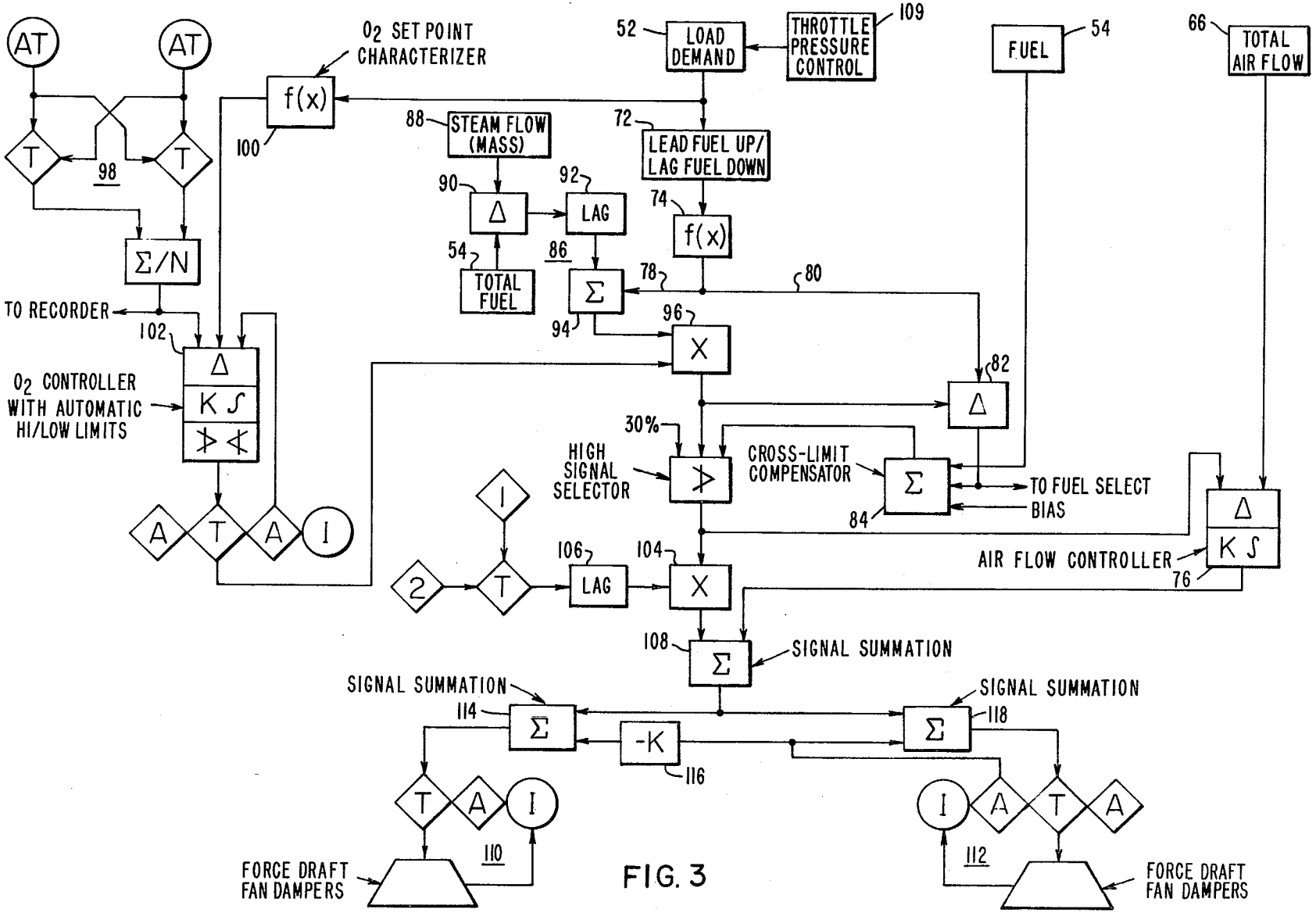
FIG. 3 shows a functional block diagram of an air control portion of the control system arranged to provide correction for fuel heating value changes.

One embodiment of the air flow control is shown in FIG. 3. Feedwater control is executed in the conventional manner consistently with fuel and air control and it is therefore not further detailed herein.

The load demand 52, which as previously noted is used in the setpoint channel for the fuel control, is applied in parallel to a setpoint channel for the air flow control. Thus, the load demand 52 is coupled through a lead-lag block 72 and a characterizer block 74 and a high selector 75 to a proportional plus integral air flow controller 72 where an error is developed from the difference between it and the total air flow feedback signal from the block 66. For safety reasons, the lead-lag block 72 causes the air flow to respond sooner than does the fuel flow to increasing load demand and vice versa for decreasing load demand. In the characterizer block 74, a suitable function generator is employed to generate an output air flow signal which demands the air flow needed to produce the input load demand.

The output from the characterizer 74 is applied to a fuel heating value correction channel 78 and a cross-limit compensation channel 80. An output signal is generated by a block 82 representing the difference between the load characterized air flow demand and a signal representing the air flow demand adjusted for fuel heating value changes. A summer 84 adds an appropriate bias signal with the difference signal from the block 82 and the actual fuel signal from the block 54 and the summation signal is applied to the high signal selector 75 along with a minimum 30% air flow signal and the air flow signal modified for fuel heating value changes for the fuel heating value correction channel 78. Cross-limit compensation is provided to maintain an accurate cross limiting action as changes occur in fuel heating value.

Circuitry 86 in the channel 78 functions with other elements of the control system 34 to provide improved control of the boiler outlet fluid as changes occur in fuel heating value under steady or changing plant load conditions. The fuel heating value correction circuitry 86 is referred to herein as a BTU correction subsystem because it compares signals representative of boiler output BTU's in the outlet fluid and presumed boiler input BTU's in the fuel, and any difference is inferred to have resulted from a change in fuel heating value. Thus, a correction signal is generated on the basis of inferred error in fuel input BTU's resulting from a fuel heating value change.

A mass steam flow signal is generated by a transducer and transmitter 88 (FIGS. 1 and 3) and it is differenced with the total fuel flow signal from block 54 in circuit 90. An inferred heat or BTU error signal is generated by the circuit 90 and applied to a lag circuit 92 which preferably limits the rate of implementation of BTU corrections to a predetermined value such as ½% per minute which allows for load changes and BTU corrections to occur without significant process interaction. Normally, BTU corrections occur for long terms and load changes occur for relatively short terms.

The lagging BTU error signal is applied to a circuit 94 in the channel 78 where it is summed with the air flow demand signal. The BTU corrected air flow demand is then applied to a multiplier circuit 96 where an oxygen correction signal is multiplied against it to provide a match between the fuel and air demands, i.e., a percentage upward or downward adjustment is made in the air flow demand according to measured oxygen in the combustion products from the furnace so that there is always a limited excess of oxygen supplied to the furnace. The oxygen correction signal is generated in the conventional manner by circuitry which includes an oxygen sensor subsystem 98, oxygen setpoint generator 100 and an oxygen controller 102.

Figures 4, 5:
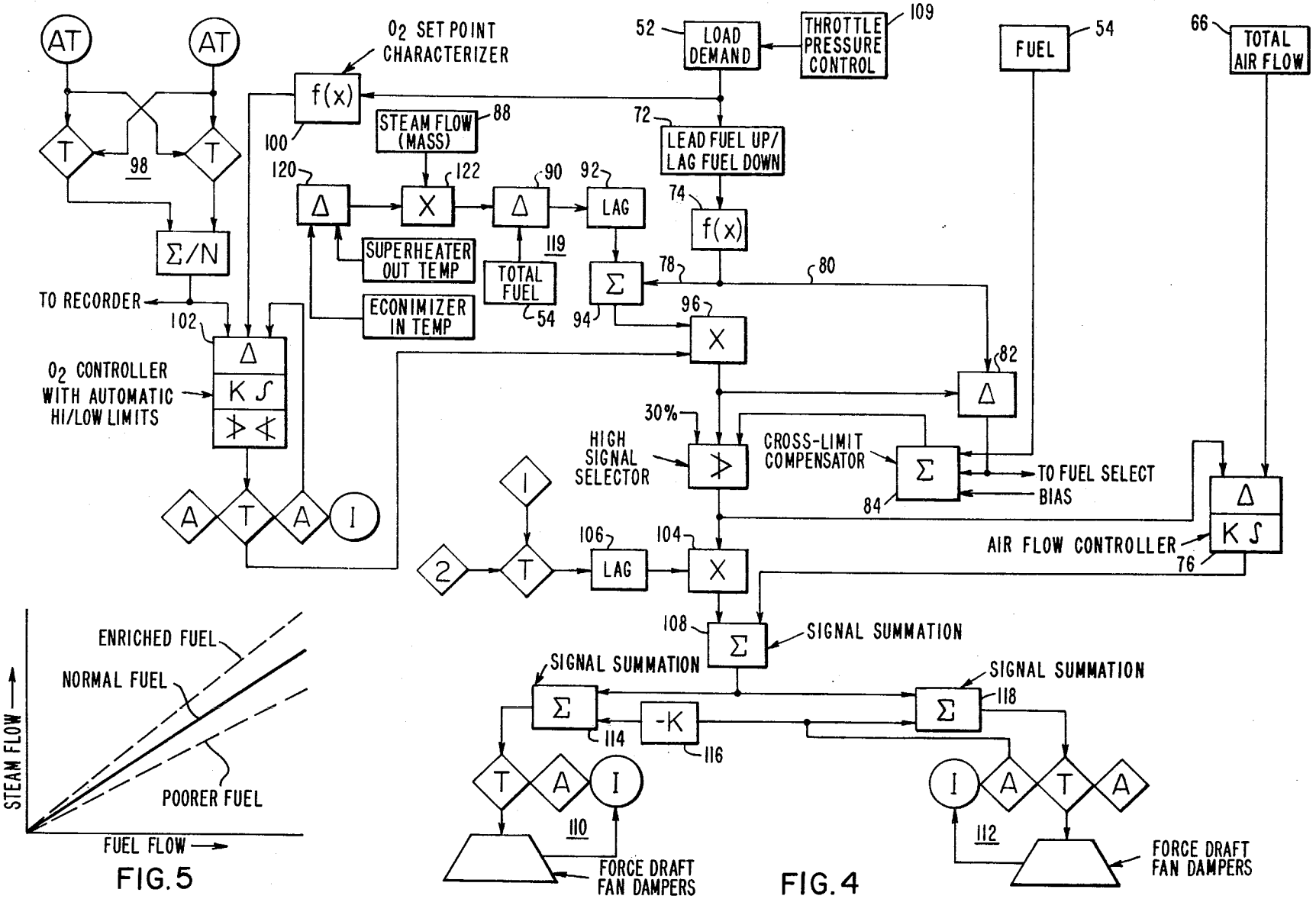
FIG. 4 shows a functional block diagram of an alternate air control portion for the control system arranged to provide corrections for BTU changes more accurately with the use of enthalpy feedback.
FIG. 5 shows a curve representing the input and output BTU relationship for the boiler.

The output from the high signal selector 76 is the corrected air flow demand unless it falls below 30% or unless cross-limit compensation becomes high, and it or the alternate high selected signal is applied to a circuit 104 where it is multiplied against a signal from a lagging circuit 106 which has a selectable lag factor. Finally, the output signal from the multiplier 104 is summed with the output from the air flow controller 76 in circuit 108 to provide an error trimmed feedforward air flow demand signal which is applied to positioning controls 110 and 112 for the fan dampers. Suitable conventional circuitry 114, 116 and 118 is provided to distribute the air flow demand equally or otherwise between the dampers. In FIG. 5, the output from the difference block 90 represents a steam flow-fuel flow characteristic in which the curve slope fuel heating value changes. The error between steam-flow and fuel varies on a ratio basis as the X-axis value changes and therefore the Y-axis value changes on a ratio of the X-axis value during load changes at constant BTU value of the fuel.

In operation, a change in the fuel heating value, such as a drop due to increased dirt content in pulverized coal, causes less boiler heat input during combustion, and steam flow tends to drop. A negative BTU error is then generated by the BTU correction system 86 and, subject to the lag effect, the air flow demand is corrected downward in block 94. Excess oxygen measurements would similarly cause a downward adjustment in air flow by action of block 96. Simultaneously, a conventional throttle pressure control 109 in the boiler control 34 responds to dropping steam flow (or dropping throttle pressure) to adjust load demand from block 52 upwardly so that desired electrical load will continue to be satisfied even though the fuel heating value has dropped. With increased load demand, the fuel flow and air flow are moved upward in step to maintain throttle pressure and desired load. With BTU correction as described, better control of boiler outlet fluid flow conditions is realized under steady or changing load conditions and as changes occur in the heating value of the input fuel. During a heating value change in the fuel, the fuel BTU/air balance does not change, i.e., no transients occur in this parameter as has happened in the prior art.

In FIG. 4, there is shown another embodiment of the invention in which elements like those shown in FIG. 3 are referenced by identical reference characters. In this case, a heat input correction system 119 is provided, and it is referred to as a Y factor correction system. Thus, the boiler heat pickup or enthalpy is determined by employing a circuit 120 to difference a signal representing the superheater outlet temperature and a signal representing the economizer inlet temperature. The output enthalpy signal provides a percentage adjustment to the steam flow mass signal in a multiplier circuit 122. The enthalpy corrected steam flow signal is then differenced with the total fuel signal in the circuit 90 and the rest of the system functions as previously described. However, any system changes other than fuel heating value changes, such as loss of a feedwater preheater, which would reduce the BTU input to the boiler are detected in the generation of the enthalpy signal from the difference circuit 120. The steam flow mass signal is modified by the multiplier circuit 122 so that it reflects only heat pickup due to fuel input and not heat pickup due to other inputs. This occurs because the energy increase of the boiler is truly measured by the mass steam flow times the enthalpy increase. Accordingly, the Y factor correction subsystem 119 provides BTU correction in the boiler control operation with greater accuracy than does the subsystem 110 under certain operating conditions.

What is claimed is:

1. A control system for a boiler or other fluid heater in which inlet fluid is heated to an elevated temperature and pressure, said system comprising means for generating a representation of load on the boiler, means for generating a demand for input fuel and a demand for input air as a function of the boiler load, means for generating respective representations of boiler outlet fluid flow and input fuel flow, means for controlling the input flow of fuel to satisfy the fuel demand, means for controlling the input flow of air to satisfy the air demand, and means for correcting one of said controlling means for changes in fuel heating value as a function of the outlet fluid flow and input fuel flow representations.

2. A control system as set forth in claim 1 wherein the boiler is a boiler which provides steam for a turbine in an electric power plant and the load demand ultimately is plnat electrical load demand.

3. A control system as set forth in claim 1 wherein means are provided for generating a heat difference between the outlet fluid flow and input fuel flow representations, said correcting means operating in response to the difference.

4. A control system as set forth in claim 1 wherein said correcting means corrects the operation of said air flow controlling means.

5. A control system as set forth in claim 4 wherein means are provided for generating a heat difference between the outlet fluid flow and input fuel flow representations, and means are provided for summing the heat difference with the air flow demand, said air flow controlling means operating in response to the air flow demand adjusted by the heat difference.

6. A control system as set forth in claim 1 wherein means are provided for generating a representation of boiler heat pickup, and said correcting means further responds to the heat pickup representation to exclude heat input changes other than fuel heating value changes from the correcting operation of said one controlling means.

7. A control system as set forth in claim 5 wherein means are provided for generating a representation of boiler heat pickup, and means are provided for adjusting the operation of said air flow controlling means in response to the heat pickup representation to exclude heat input changes other than fuel heating value changes from the correcting operation of said air flow controlling means.

8. A control system as set forth in claim 1 wherein means are provided for restricting the implementation of corrective control by said one correcting means to avoid interaction with control actions undertaken to implement load demand changes.

9. A control system as set forth in claim 8 wherein said restricting means restricts the rate at which corrective feedback is applied by said correcting means.

10. A control system as set forth in claim 5 wherein means are provided for restricting the implementation of corrective control by said one correcting means to avoid interaction with control actions undertaken to implement load demand changes, said restricting means couples said heat difference to said air flow controlling means to restrict the rate at which the heat difference demands corrective air flow change.

11. A control system as set forth in claim 4 wherein the boiler is a boiler which provides steam for a turbine in an electric power plant and the load demand ultimately is plant electrical load demand.

12. A control system as set forth in claim 11 wherein means are provided for generating a heat difference between the outlet fluid flow and input fuel flow representations, and means are provided for summing the heat difference with the air flow demand, said air flow controlling means operating in response to the air flow demand adjusted by the heat difference.

13. A control system as set forth in claim 4 wherein means are provided for generating a representation of boiler heat pickup, and said correcting means further responds to the heat pickup representation to exclude heat input changes other than fuel heating value changes from the correcting operation of said one controlling means.

14. A control system as set forth in claim 4 wherein means are provided for restricting the implementation of corrective control by said one correcting means to avoid interaction with control actions undertaken to implement load demand changes.

15. A control system as set forth in claim 12 wherein at least all of said generating means and said summing means are provided in the form of hard circuits.

* * * * *